US009410317B1

(12) United States Patent
Kilian et al.

(10) Patent No.: US 9,410,317 B1
(45) Date of Patent: Aug. 9, 2016

(54) MODULAR LATTICE-CONFIGURED PANEL FIXTURES AND METHODS FOR MANUFACTURING THE SAME

(71) Applicant: ARKTURA LLC, Gardena, CA (US)

(72) Inventors: Robert Kilian, Venice, CA (US); Kevin Kane, Los Angeles, CA (US); Chris Kabatsi, Venice, CA (US)

(73) Assignee: Arktura LLC, Los Angeles, CA (US)

( * ) Notice: Subject to any disclaimer, the term of this patent is extended or adjusted under 35 U.S.C. 154(b) by 0 days.

(21) Appl. No.: 14/791,341

(22) Filed: Jul. 3, 2015

(51) Int. Cl.
*E04H 12/00* (2006.01)
*E04B 9/04* (2006.01)
*E04B 9/22* (2006.01)

(52) U.S. Cl.
CPC .. *E04B 9/04* (2013.01); *E04B 9/225* (2013.01)

(58) Field of Classification Search
CPC ..... E04B 9/04; E04B 9/225
USPC ..... 52/63, 81.1, 648.1, 646
See application file for complete search history.

(56) References Cited

U.S. PATENT DOCUMENTS 1,721,338 A * 7/1929 Gagnon ..... A47H 13/02 16/87.8
2,314,456 A * 3/1943 Nadell ..... B63B 3/26 52/267
2,571,052 A * 10/1951 Mount ..... F16G 11/00 403/57
3,407,560 A * 10/1968 Baumann ..... E04B 1/19 29/433
3,429,607 A * 2/1969 White ..... E04B 1/4142 294/89
4,505,019 A * 3/1985 Deinzer ..... B21F 27/128 228/120
4,611,450 A * 9/1986 Chen ..... E04C 2/22 428/222
4,757,665 A * 7/1988 Hardigg ..... B29C 45/26 52/782.1
5,163,492 A * 11/1992 Remington ..... E06B 9/307 160/176.1 V
6,993,879 B1 * 2/2006 Cantley ..... E04C 3/28 446/124
8,833,000 B1 * 9/2014 Nadeau ..... E04B 1/34 52/63
9,127,450 B2 * 9/2015 Rivers ..... E04B 1/19
2004/0107669 A1 * 6/2004 Francom ..... E04C 3/08 52/697
2009/0274865 A1 * 11/2009 Wadley ..... C23C 16/045 428/110
2011/0005160 A1 * 1/2011 Nihei ..... B25J 9/1075 52/645
2011/0283873 A1 * 11/2011 Wadley ..... F41H 5/023 89/36.02

* cited by examiner

*Primary Examiner* — Brian Glessner
*Assistant Examiner* — Joshua Ihezie
(74) *Attorney, Agent, or Firm* — Zuber Lawler & Del Luca LLP; Matthew J. Spark

(57) ABSTRACT

The invention provides lattice-configured panel fixtures that include a plurality of rods joined together in a predetermined pattern, articles for supporting the panel fixtures from a support structure, and automated systems and methods for manufacturing the panel fixtures.

24 Claims, 11 Drawing Sheets

Plan

Section

Rods length

| | | | |
|---|---|---|---|
| 1 | 1.25' | 16 | 3.4' |
| 2 | 1.35' | 17 | 3.45' |
| 3 | 1.62' | 18 | 3.58' |
| 4 | 1.88' | 19 | 3.82' |
| 5 | 2.2' | 20 | 3.84' |
| 6 | 2.22' | 21 | 3.85' |
| 7 | 2.28' | 22 | 3.87' |
| 8 | 2.29' | 23 | 4' |
| 9 | 2.35' | 24 | 4.08' |
| 10 | 2.36' | 25 | 4.27' |
| 11 | 2.51' | 26 | 4.55' |
| 12 | 2.55' | 27 | 4.61' |
| 13 | 2.91' | 28 | 4.64' |
| 14 | 3.01' | 29 | 4.85' |
| 15 | 3.37' | 30 | 4.88' |

MODULAR LATTICE-CONFIGURED PANEL FIXTURES AND METHODS FOR MANUFACTURING THE SAME

FIELD OF THE INVENTION

The invention relates to the field of ceiling and wall fixtures.

BACKGROUND OF THE INVENTION

Various types of ceiling and wall treatments such as stucco, paneling, tin ceiling tiles and drop ceilings are known in the art.

What is needed and provided by the present invention are new types of ceiling and wall fixtures.

SUMMARY OF THE INVENTION

One embodiment provides a lattice-configured fixture panel having an expansive horizontal dimension with a top side and a bottom side and a vertical height, said panel including:

a plurality of rods each having a first and second end and a length, wherein at least some of the rods have different lengths, wherein each rod is directly joined to at least two other rods, wherein the intersection of rods in the horizontal dimensions occurs at a plurality of acute and obtuse angles. At least half of the rods, such as at least 80% or all of the rods, of the panel may be tilted such that their first ends and second ends are disposed at different vertical heights. The expansive horizontal dimension of the panel may have an at least substantially rectangular configuration with four sides and the vertical height of the panel may be at least 5-10 times, such as 6-8 times, smaller than the longest of the four sides of the substantially rectangular configuration. The fixture may further include a plurality of wire-hanging support brackets attached to the top side of the panel.

Another embodiment of the invention provides an automated manufacturing system for producing lattice-configured panel fixtures that includes:

a rod support jig comprising an expansive base and a plurality of rod support tabs extending upwardly from the base to predetermined heights at predetermined positions;

a computerized manufacturing control unit comprising at least one processor, processor-accessible tangible memory and processor-executable computer instructions stored in the processor-accessible memory;

a first articulated robot arm under control of the at least one processor, said arm comprising a grabbing tool; and a second articulated robot arm under control of the at least one processor, said arm comprising a joining tool;

wherein the computer instructions are configured to direct the at least one processor to control the first and second robot arms to perform an ordered plurality of steps including placing rods of predetermined lengths in the jig and joining the rods together according to a predetermined pattern to form a lattice-configured panel fixture.

A related embodiment of the invention provides an automated method for manufacturing lattice-configured panel fixtures that includes the steps of:

providing a manufacturing system that includes:

a rod support jig comprising an expansive base and a plurality of rod support tabs extending upwardly from the base to predetermined heights at predetermined positions, a computerized manufacturing control unit comprising at least one processor, processor-accessible tangible memory and processor-executable computer instructions stored in the processor-accessible memory, a first articulated robot arm under control of the at least one processor, said arm comprising a grabbing tool, and a second articulated robot arm under control of the at least one processor, said arm comprising a joining tool, wherein the computer instructions are configured to direct the at least one processor to control the first and second robot arms to perform an ordered plurality of steps including placing rods of predetermined lengths in the jig and joining the rods together according to a predetermined pattern to form a lattice-configured panel fixture; and the first and second robot arms placing rods of predetermined lengths in the jig and joining the rods together under control of the at least one processor according to a predetermined pattern and order to form the lattice-configured panel fixture. Each rod may be joined to at least two other rods to form the fixture.

The method may further include the steps of:

providing a plurality of support brackets for joining to some of the rods; and joining the plurality of support brackets to different predetermined rods of the fixture panel at predetermined positions on the different predetermined rods. The joining of the brackets to the rods may be performed by the first and second robot arms.

Other objects and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

The invention provides lattice-configured panel fixtures for ceilings and walls that are made of a plurality of rod elements joined to each other. The invention also provides automated systems and methods for manufacturing the fixtures.

The rod elements may, for example, be solid, hollow or tubular and may be metallic, such as but not limited to aluminum, or non-metallic, such as a synthetic polymer or wood. The cross-sectional profile of the rods may, for example, be oval, circular, rectangular, square, triangular or any shape. For a single panel fixture or group of panel fixtures, all of the rods may have the same cross-sectional shapes or a plurality of different shaped rods may be used. At least some of the rods in a single panel fixture may have different cross-sectional dimensions (different diameters) or they may all have the same cross-sectional dimensions (same diameters). Each panel fixture may be made from a plurality of rods wherein at least some of the rods, such as all of the rods, have different lengths. For example, each panel fixture may be made of rods having 2, 3, 4, 5, 6, 7, or 8 different lengths. For all of the different length rods used to make a panel fixture, at least two of the rods of each length may be included in the panel fixture.

The rods are arranged and joined in a three-dimensional lattice configuration having an expansive dimension and a thickness or height to provide the form of a panel. For each panel fixture, each component rod may touch (be joined to) at least one other rod via weldment or other fastening method (glue, fastener, etc.), creating the structural integrity of the module. In another variation, each of the rods may touch (be joined to) at least two, such as two or three, other rods of the module.

Figures 8, 9:
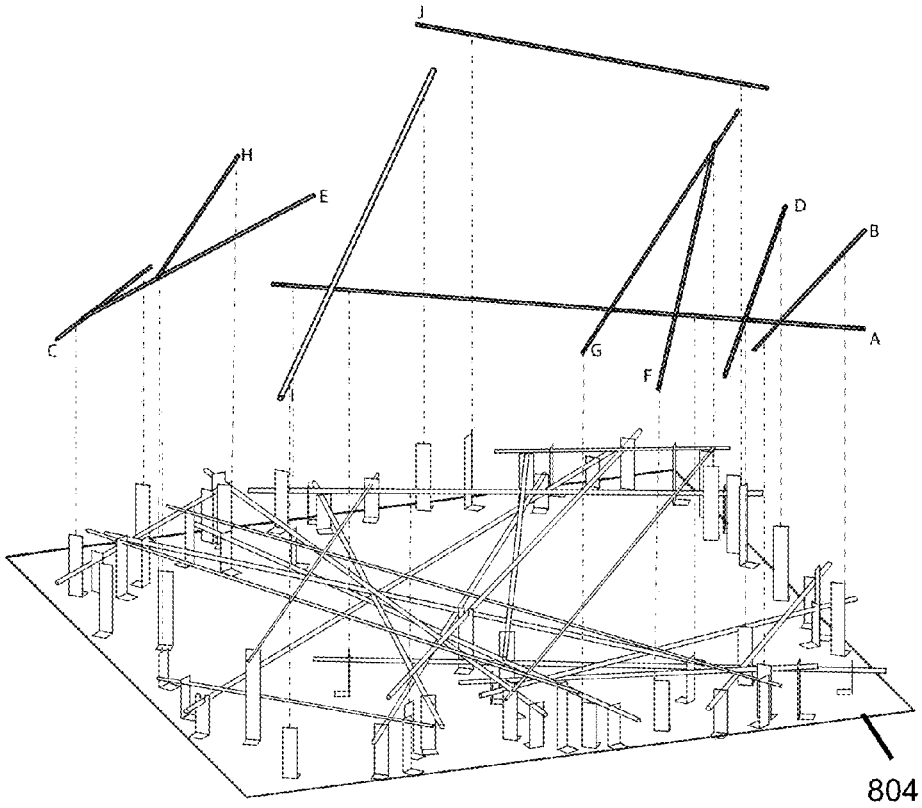
FIG. 8 illustrates the stacking order of rods for the manufacture of a panel fixture embodiment of the invention.
FIG. 9 is table showing the lengths of rods in one panel embodiment of the invention.

At least some of the rods may be straight such as all of the rods may be straight (as shown in the figures). In a variation, none of the rods in a single panel fixture are collinear. In a variation, none of the rods may be at a right angle to a rod it touches (is joined to). In a variation, none of the rods in a panel may be at a right angle to each other. At least some of the rods may be curved, such as all of the rods may be curved. With respect to the height (thickness) of the panel, at least some of the rods of the panel may be axially tilted in the z-plane (rather than level). The total number of rods in a panel may, for example, be in the range of 5-50, such as 5-35, such as 10-30, such as 10-20, such as 10-15. In one embodiment, for a panel having a 48"×48" border, the rods may vary in length from 12 inches to 60 inches. In one variation, none of the rods in the panel are the same length. FIG. 9 is a table showing the rods lengths for a panel embodiment of the invention.

The entire grouping of rods in a panel may be contained within a rectilinear profile, such as a rectangular or square profile (of the expansive dimension) with varying heights possible in the z-plane envelope. The ratio of the longest dimension in the expansive plane to the height (thickness) of the panel may, for example, be in the range of 40:1 to 4:1. In one embodiment, the panel fixture has an approximate 48"L× 48"W area in the expansive plane with varying heights of z plane envelope achieving a maximum of approximately 12".

When viewed from above or below, the projection of the expansive dimension of a panel embodiment of the invention may, for example, have in the range of 60%-90% open area (area not blocked by the projection of area taken up by the rods). In the expansive dimension, the panel may, for example, consist of 50-120 open areas bounded by the projection of the rods making up the panel. The density of the rods in the area of the expansive dimension of a panel may be significantly less than the density of the rods viewed from the side of the panel.

There may, for example, be 2 to 4 attachments points on the same side of a panel fixture for hanging or otherwise attaching the panel to a ceiling or wall. A tab, i.e., a hanging plate, configured to reversibly attach to a support wire may be connected to a rod of the panel at each of the attachment points. A slot and/or hole may be formed in the tab which is configured to receive a ball end of a wire or other wire connection to a hole or hook in the tab. The other end of the wire may be fastened to the base building support structure above in a manner appropriate for the specific condition of that substrate. Multiple panel fixtures may be installed adjacent to each other as modules.

The manufacture of the panel fixtures according to the invention may be automated and performed, at least in part, by industrial robots. The rods are cut into a variety of required lengths from longer rods, or otherwise provided in the needed lengths, and then stocked in a picking rack with like sizes. A plurality of hanging plates may also be provided in the vicinity for use in the manufacturing process. The rods are then picked by a robotic claw and placed into a custom fixture (jig) to a specific location in a specific sequence. This assembly logic avoids lock outs or collisions among the rods. A robot arm then passes over the fixture touching and joining sticks at their points of intersection via welding, fastener or glue, etc. The hanging plates are then picked by the robotic claw, and held in place while the secondary robot fastens them with one of the methods mentioned above. Suitable programmable industrial robot systems including articulated robot arms with grasping and welding capabilities are commercially available and well known in the manufacturing art.

Various aspects of the invention are further described below with reference to the accompanying drawing.

Figure 1A:
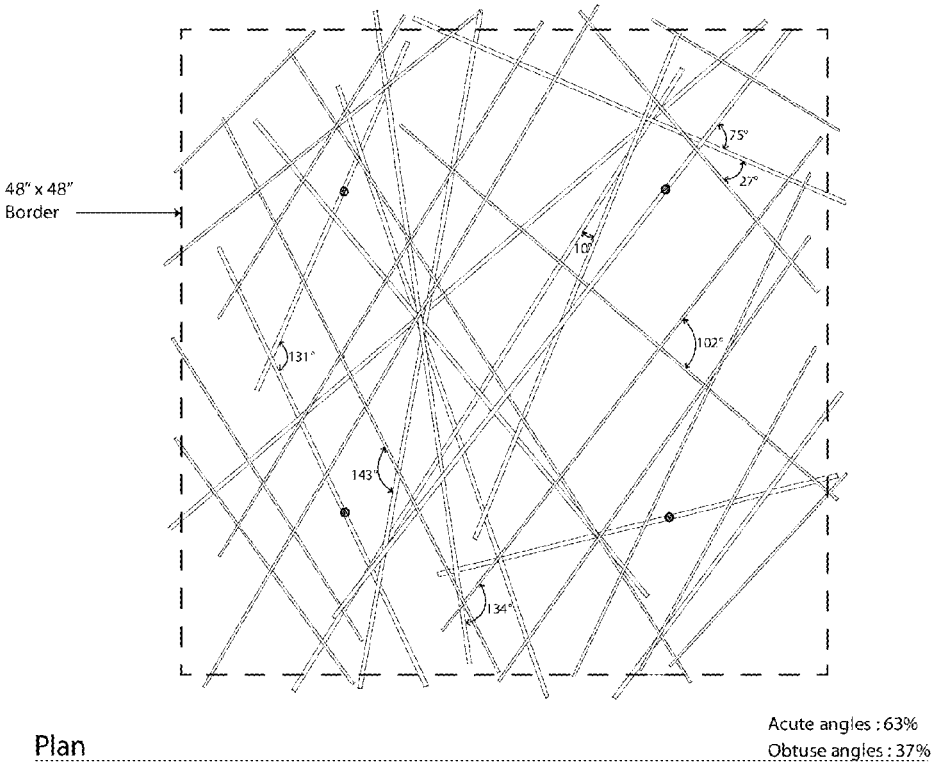
FIG. 1A shows a top plan view of a lattice-configured modular panel embodiment of the invention.
Figure 1B:
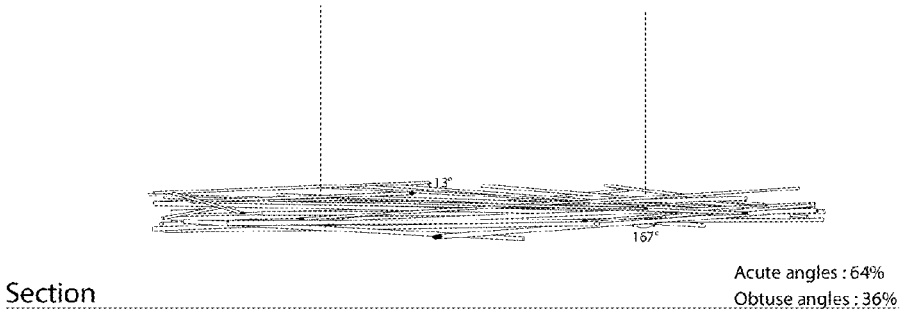
FIG. 1B shows a side elevational view of the embodiment shown in FIG. 1A.

FIG. 1A shows a top plan view of a lattice-configured modular panel embodiment of the invention. The rods are disposed within a square 48"×48" imaginary border except that the ends of some rods extend slightly past the border on each side of the panel. Various angles between the rods are shown. Overall, there are 63% acute angles and 37% obtuse angles between the rods, in the perspective shown. Four support attachment points are shown by black dots. FIG. 1B shows a side elevational view of the embodiment shown in FIG. 1A. Various angles between the rods are shown for this perspective. Overall, there are 64% acute angles and 36% obtuse angles in this perspective. Two of the support wires attached to the panel are shown (the other two are obscured by those shown).

Figure 2A:
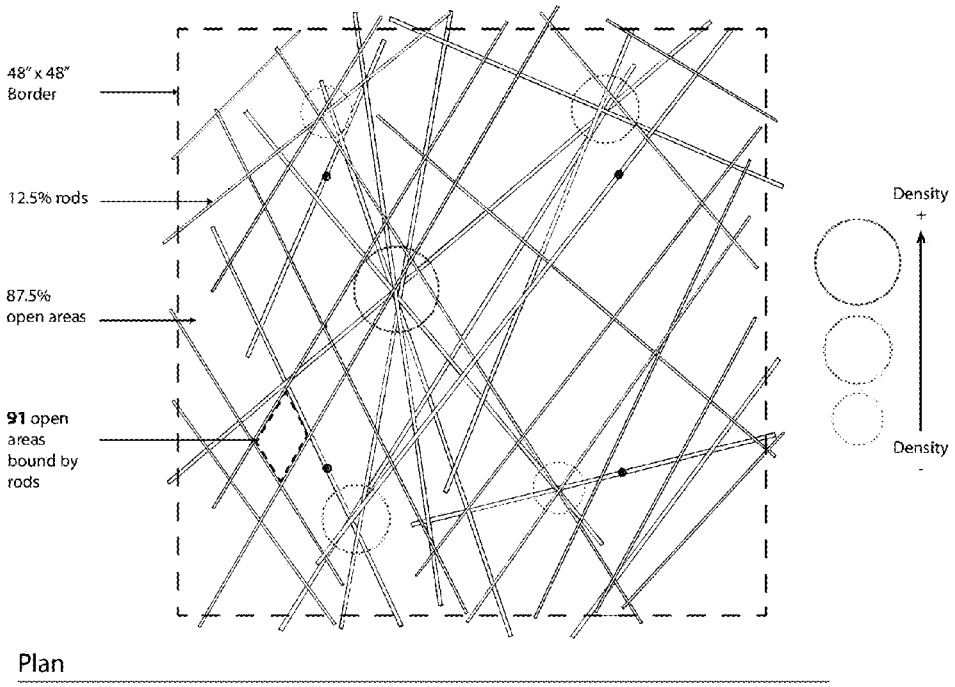
FIG. 2A is a density diagram in the horizontal plane (expansive dimension) for the embodiment shown in FIGS. 1A and 1B.
Figure 2B:
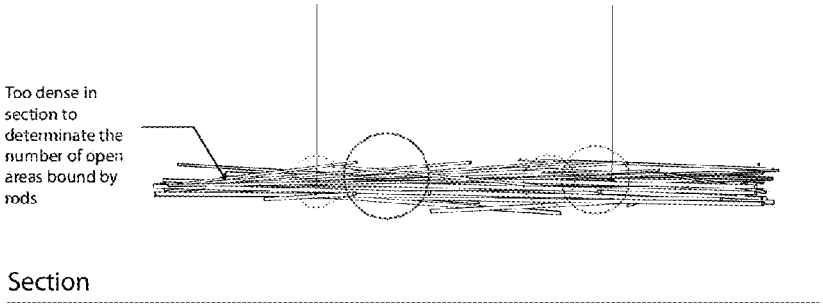
FIG. 2B is a density diagram in the vertical plane for the embodiment shown in FIGS. 1A and 1B.

FIG. 2A is a density diagram in the horizontal plane (expansive dimension) for the embodiment shown in FIGS. 1A and 1B. The density of the rods in two dimensions varies across the panel. FIG. 2B is a density diagram for the vertical plane for the embodiment shown in FIGS. 1A and 1B. The density of the rods in the vertical plane as viewed from the side of the panel is much greater than that in the horizontal plane.

Figure 3A:
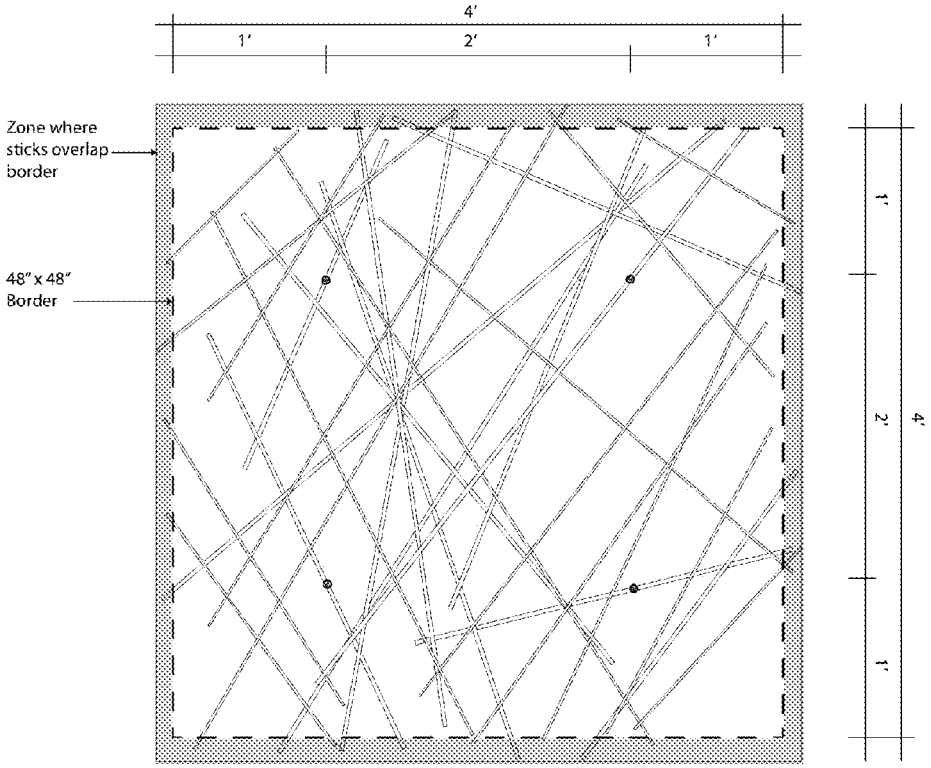
FIG. 3A shows the rectangular envelope and peripheral overlap zones for the modular panel embodiment shown in FIG. 1A.
Figure 3B:
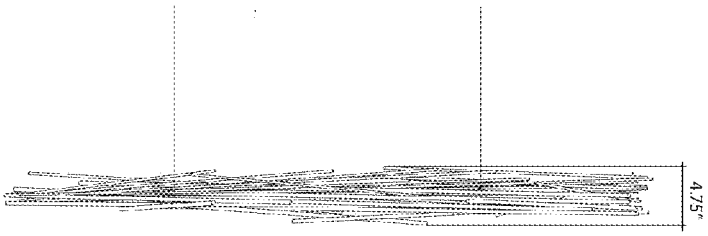
FIG. 3B shows a side elevational view of the embodiment.

FIG. 3 shows the rectangular 48"×48" envelope and peripheral overlap zones for the modular panel embodiment shown in FIG. 1A.

Figure 4A:
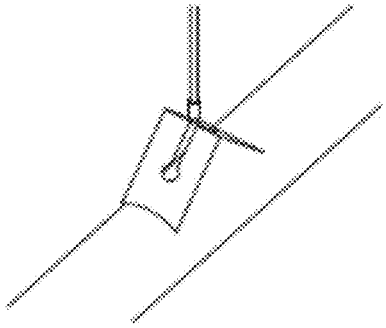
FIG. 4A shows a perspective view of a hanger bracket attached to a rod and connected to a support wire.
Figure 4B:
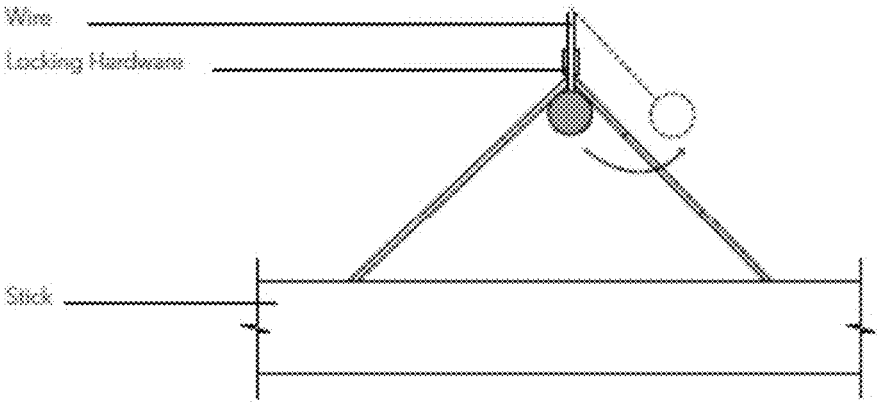
FIG. 4B shows a side view of the hanging hardware in more detail.
Figure 4C:
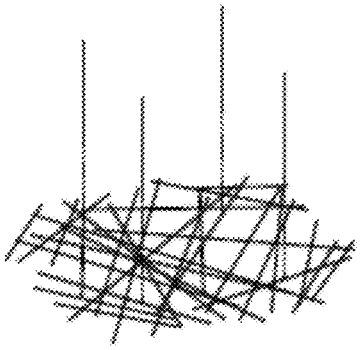
FIG. 4C shows how a lattice-configured panel embodiment of the invention may be hung from four points.

FIG. 4A shows a perspective view of a hanger element (tab, bracket, plate) embodiment of the invention attached to a rod and connected to a support wire. The attachment may, for example, include a weld, mechanical attachment such as with a fastener, and/or adhesive attachment. The hanger element may be formed from a bent metal plate. A hole and connected slot are formed in the hanger element so that a terminal ball member of a support wire can pass through the hole, which has a diameter wider than the width of the slot, and be captively retained by the slot while the panel hangs from the support wire. The terminal ball member and hole and slot of the hanger are mutually sized and configured so that the ball can pass through the hole from one side of the hanger plate to the other and vertically ride up the slot (as the wire connected to the ball member moves along the slot) whilst the width of the slot is smaller than the ball member thereby preventing it from passing through the slot itself to the other side of the hanger plate. In the embodiment shown, the ends of the hanger elements are curved to match the curvature of the rod to which they are attached (in this case, having a circular cross-section). FIG. 4B shows a side view of the hanging hardware in more detail. FIG. 4C shows how a lattice-configured panel embodiment of the invention may be hung from four points. The invention also provides hanger plates having a bend defining a vertex and a slot extending downward on each side of the bend, to a hole having a width/diameter larger than the width of the slot on each side. The slot on each side may be part of one continuous slot, or the slot on each side may be a separate, unconnected slot.

Figure 5:
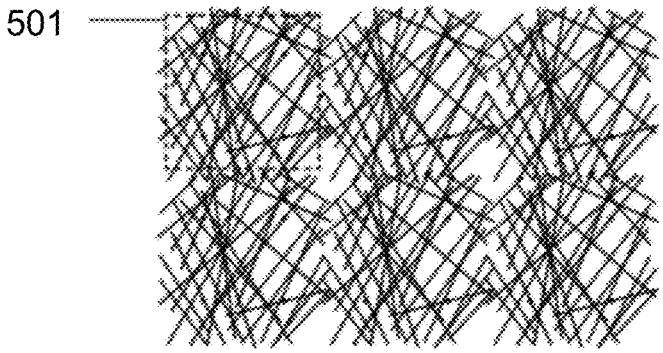
FIG. 5 shows an embodiment of the invention that includes an array of six lattice-configured panel fixtures.

FIG. 5 shows an embodiment of the invention that includes an array of six lattice-configured panel fixtures (one labeled 501) disposed next to each other. The rod ends that extend into the overlap zone (beyond the 48"×48" envelope in FIG. 3) for each panel overlap each other for the adjacent sides of neighboring panels. In this manner, the array of panels takes on a unitary appearance to the observer. The four support attachment points for each of the modules are shown by black dots in the figure.

Figure 6:
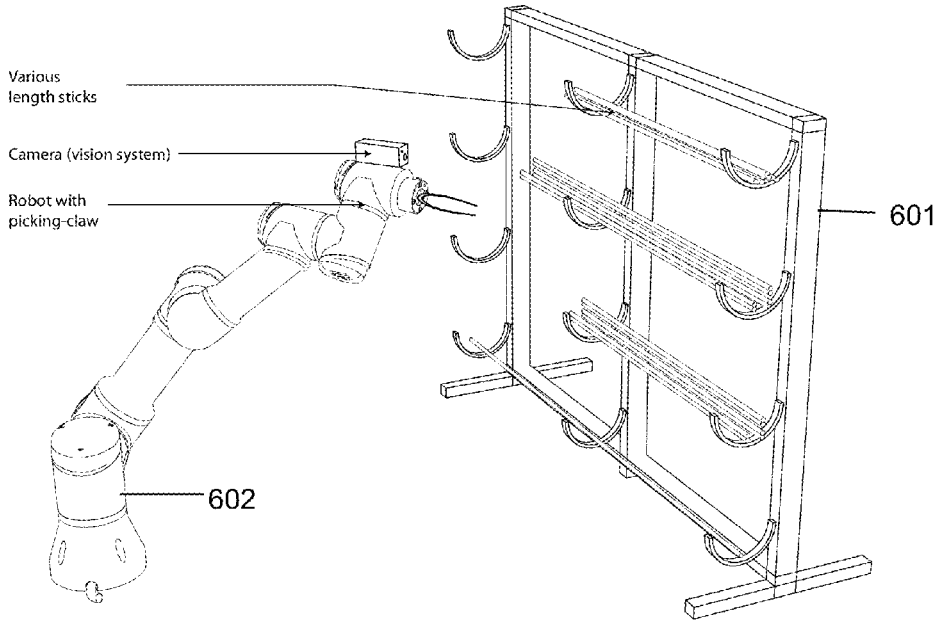
FIG. 6 shows an embodiment of an automated rod picking system including a rod storage rack and a robotic picking arm, which may be employed in the manufacture of lattice-configured panel fixtures according to the invention.

FIG. 6 shows an embodiment of an automated rod picking system including a rod storage rack 601 and a robotic picker 602, which may be employed in the manufacture of lattice-configured panel fixtures according to the invention.

Figure 7:
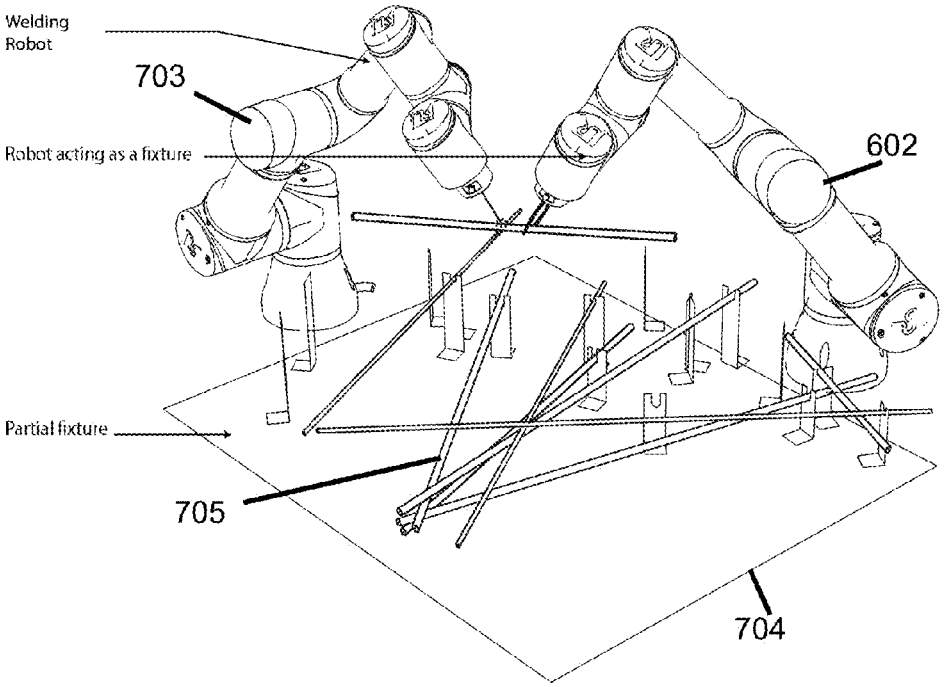
FIG. 7 shows a manufacturing system embodiment of the invention that includes a rod placement jig, a robotic picking/placing arm, a robotic welding arm and a partially constructed lattice-configured panel fixture.

FIG. 7 shows a manufacturing system embodiment of the invention that includes a robotic picking/placing arm 602, robotic welding arm 703, a rod placement jig 704, and a partially constructed lattice-configured panel fixture 705. Jig 704 includes a base from which upwardly extending support tabs are disposed. Each of the support tabs includes a notch at its top end which is sized and configured so that the rod stock can rest within the notch.

FIG. 8 illustrates the stacking order of rods for the manufacture of a panel fixture embodiment of the invention. A rod placement jig 804 is shown with the complete set of rods joined as a panel. The placement order of particular rods is correspondingly represented by the numbering of the projected rods represented above jig 804 (the first placed rod being number 1, the second placed being number 2, and so on). For any particular panel fixture embodiment of the invention, the placement order of the rods (and corresponding joining process(es)) may be programmed into the robotic systems.

Figure 10A:
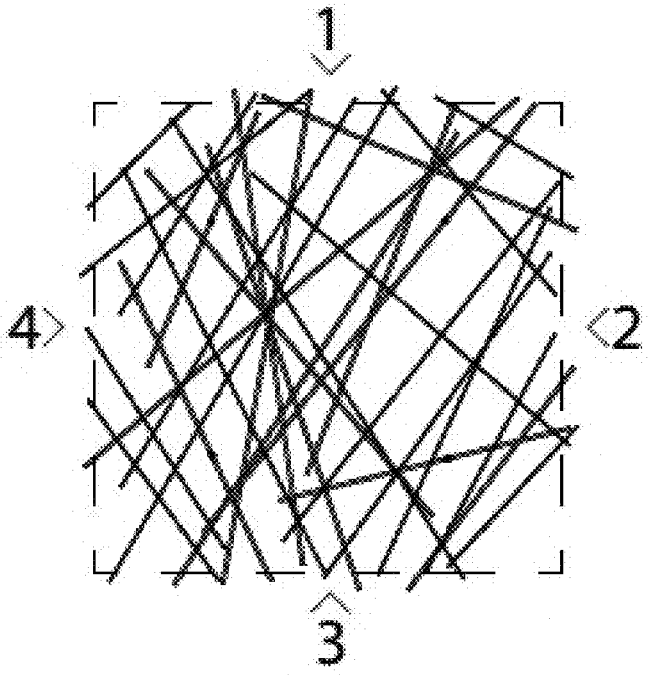
FIG. 10A is a key diagram enumerating the four sides of the panel embodiment shown in FIG. 1A. Each of FIGS. 10B-10E shows an elevational view of one of the four sides.
Figure 10B:
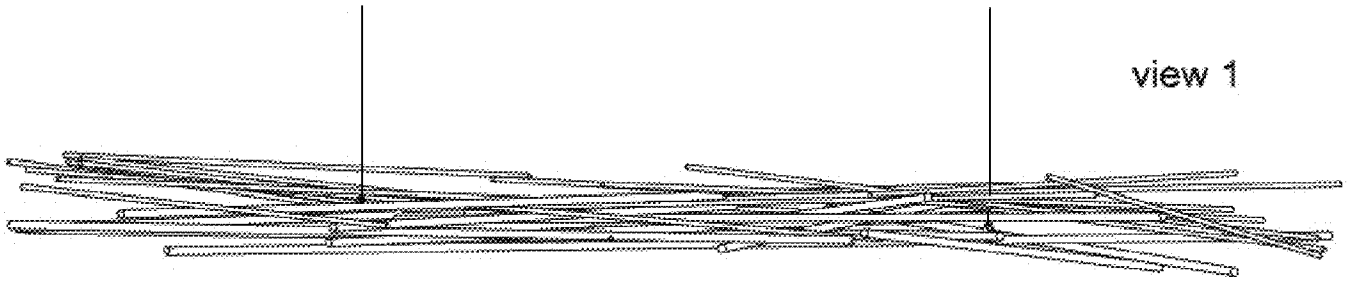
FIG. 10B shows side 1.
Figure 10C:
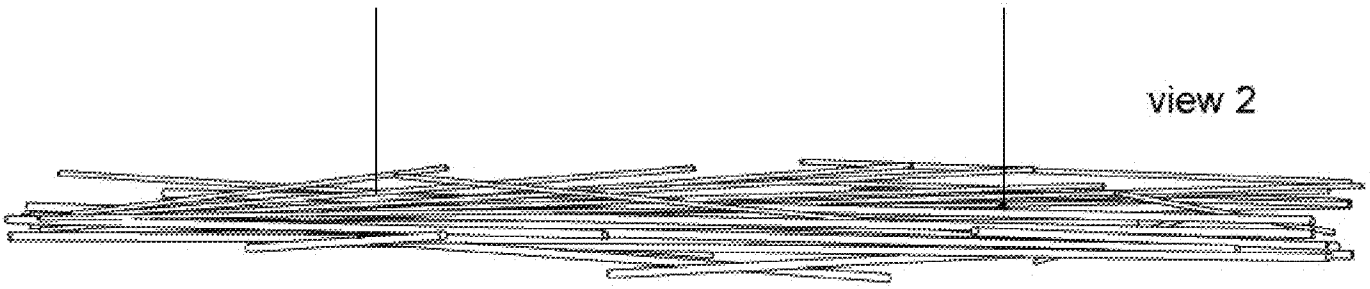
FIG. 10C shows side 2.
Figure 10D:
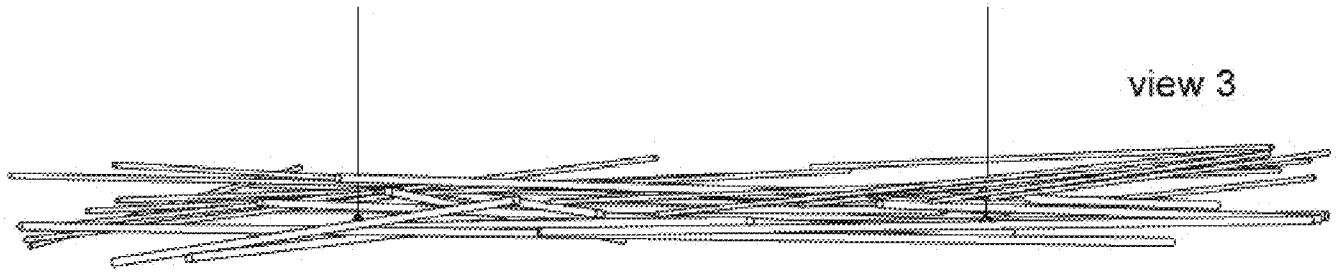
FIG. 10D shows side 3.
Figure 10E:
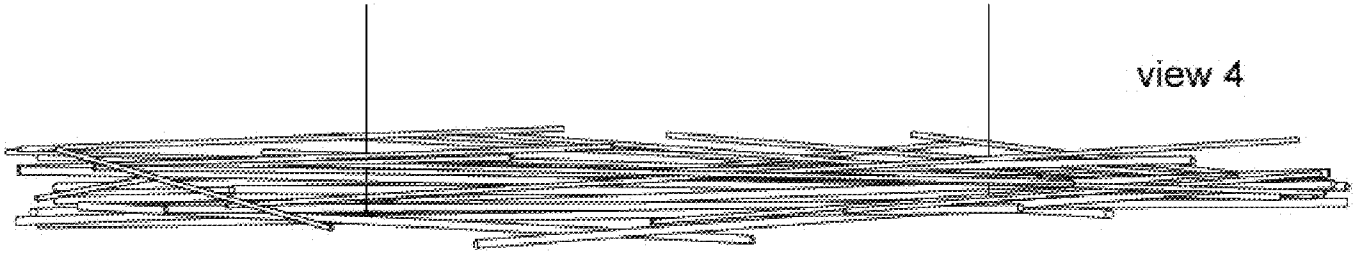
FIG. 10E shows side 4.

FIG. 10A is a key diagram enumerating the four sides of the panel embodiment shown in FIG. 1A. Side 1 is the rear side; side 2 is the right side, side 3 is the front side; and side 4 is the left side. Each of FIGS. 10B-10E shows the corresponding elevational views of the four sides. In one aspect, the invention also provides the design and shape of a fixture panel as shown in any one of or combination of the figures, with or without the hangers and/or support wires.

Although the foregoing description is directed to the preferred embodiments of the invention, other variations and modifications may be made without departing from the spirit or scope of the invention. Moreover, features described in connection with one embodiment of the invention may be used in conjunction with other embodiments, even if not explicitly stated above.

What is claimed is:

1. A lattice-configured fixture panel having an expansive horizontal dimension with a top side and a bottom side and a vertical height, said panel comprising:

a plurality of rods each having a first and second end and a length, wherein at least some of the rods of the plurality of rods have different lengths, wherein at least some of the rods of the plurality of rods are irregularly disposed, wherein the rods of the plurality of rods intersect in the horizontal dimensions at a plurality of acute and obtuse angles at points between their ends, wherein each rod of the plurality of rods is directly joined to at least two other rods that it intersects with in the horizontal dimension at the points of intersection with said at least two other rods, and wherein at least some of the rods of the plurality of rods are tilted such that their first ends and second ends are disposed at different vertical heights.

2. The lattice-configured fixture panel of claim 1, wherein at least half of the rods of the panel are tilted such that their first ends and second ends are disposed at different vertical heights.

3. The lattice-configured fixture panel of claim 1, further comprising:

a plurality of wire-hanging support brackets attached to the top side of the panel.

4. The lattice-configured fixture panel of claim 3, wherein each of the wire-hanging support brackets comprises a plate having formed therein a slot having a width and a longitudinal dimension that extends in a vertical direction to a highest point and a hole having a width greater than the slot which communicates with the slot and is disposed vertically below the highest point of the slot.

5. The lattice-configured fixture panel of claim 4, further comprising:

for each wire-hanging support bracket, a support wire a having a diameter, a top end and a bottom end, wherein the bottom end comprises and terminates in a ball having a diameter that is larger than the diameter of the support wire, larger than the diameter of the slot and smaller than the diameter of the hole and wherein the top end is attached to a support structure, and wherein the ball at the bottom end of each of the support wires is captively held by a different support bracket so that the lattice-configured fixture panel hangs by the support wires from the support structure.

6. The lattice-configured fixture panel of claim 4, wherein the plate of each wire-hanging support bracket is an elongated plate having a longitudinal axis and two ends, wherein a bend is formed between the two ends along a fold line transverse to the longitudinal axis of the plate thereby forming a high point at the bend with a first section of the plate on one side of the bend and a second section of the plate on the other side of the bend, wherein the hole and the slot are formed in one of the first section and the second section of the plate, and wherein each end of the plate is joined to a single rod of the lattice-configured fixture panel.

7. The lattice-configured fixture panel of claim 1, wherein none of the rods are collinear.

8. The lattice-configured fixture panel of claim 7, wherein none of the rods are disposed at a right angle to a joined rod.

9. The lattice-configured fixture panel of claim 1, wherein all the rods are irregularly disposed.

10. A hanging fixture array, comprising:

a plurality of lattice-configured fixture panels according to claim 3, each panel hanging from an overhead support structure by wires attached to the wire-hanging support brackets of the panel, wherein there are panels of the plurality of panels that are disposed next to each other in the horizontal dimension such that rod ends of the panels disposed next to each other horizontally extend into an area of overlap between said panels.

11. An automated manufacturing system for producing lattice-configured fixture panels according to claim 1, comprising a rod support jig comprising an expansive base and a plurality of rod support tabs extending upwardly from the base to predetermined heights at predetermined positions;

a computerized manufacturing control unit comprising at least one processor, processor-accessible tangible memory and processor-executable computer instructions stored in the processor-accessible memory;

a first articulated robot arm under control of the at least one processor, said arm comprising a grabbing tool;

a second articulated robot arm under control of the at least one processor, said arm comprising a joining tool;

wherein the computer instructions are configured to direct the at least one processor to control the first and second robot arms to perform an ordered plurality of steps including placing rods of predetermined lengths in the jig and joining the rods together according to a predetermined pattern to form a lattice-configured panel fixture.

12. The automated manufacturing system of claim 11, wherein each rod of the lattice-configured panel fixture is joined to at least two other rods of the fixture.

13. The automated manufacturing system of claim 11, further comprising:

a picking rack sized and configured to stock rods segregated by length and disposed such that the first articulated robot arm can pick rods from the picking rack.

14. The manufacturing system of claim 13, wherein the picking rack comprises a plurality of rods segregated according to length.

15. The manufacturing system of claim 13, further comprising a plurality of support brackets for joining to a manufactured panel fixture.

16. The manufacturing system of claim 14, further comprising a plurality of support brackets for joining to a manufactured panel fixture.

17. The manufacturing system of claim 16, wherein the computer instructions are further configured to direct the at least one processor to control the first and second robot arms to join a plurality of support brackets to the lattice-work panel fixture.

18. The automated manufacturing system of claim 11, wherein the joining tool is a welding tool.

19. The automated manufacturing system of claim 12, wherein the joining tool is a welding tool.

20. An automated method for manufacturing lattice-configured fixture panels according to claim 1, comprising the steps of:

providing a manufacturing system comprising:

a rod support jig comprising an expansive base and a plurality of rod support tabs extending upwardly from the base to predetermined heights at predetermined positions, a computerized manufacturing control unit comprising at least one processor, processor-accessible tangible memory and processor-executable computer instructions stored in the processor-accessible memory, a first articulated robot arm under control of the at least one processor, said arm comprising a grabbing tool, and a second articulated robot arm under control of the at least one processor, said arm comprising a joining tool, wherein the computer instructions are configured to direct the at least one processor to control the first and second robot arms to perform an ordered plurality of steps including placing rods of predetermined lengths in the jig and joining the rods together according to a predetermined pattern to form a lattice-configured panel fixture; and the first and second robot arms placing rods of predetermined lengths in the jig and joining the rods together under control of the at least one processor according to a predetermined pattern and order to form the lattice-configured panel fixture.

21. The method of claim 20, wherein each rod is joined to at least two other rods to form the fixture.

22. The method of claim 20, further comprising the steps of:

providing a picking rack sized and configured to stock rods segregated by length and disposed such that the first articulated robot arm can pick rods from the picking rack, wherein the first articulated robot arm pics rods from the picking rack and disposes the rods at preset locations for joining to other rods by the second articulated robot arm.

23. The method of claim 20, further comprising the steps of:

providing a plurality of support brackets for joining to some of the rods; and joining the plurality of support brackets to different predetermined rods of the fixture panel at predetermined positions on the different predetermined rods.

24. The method of claim 23, wherein the step of joining the plurality of support brackets to different predetermined rods of the fixture panel at predetermined positions on the different predetermined rods is performed by the first and second robot arms under control of the at least one processor.

* * * * *